United States Patent [19]

Kralowetz

[11] Patent Number: 4,461,163

[45] Date of Patent: Jul. 24, 1984

[54] SWAGING MACHINE

[76] Inventor: Bruno Kralowetz, St. Ulrich, A-4400 Steyr, Austria

[21] Appl. No.: 436,272

[22] Filed: Oct. 25, 1982

[30] Foreign Application Priority Data

Nov. 13, 1981 [AT] Austria ..... 4881/81

[51] Int. Cl.[3] ..... B21J 7/14

[52] U.S. Cl. ..... 72/402; 72/403

[58] Field of Search ..... 72/402, 403, 76, 456, 72/374, 285, 453.01, 453.02, 407; 100/232, 264; 308/3 A, 3 R

[56] References Cited

U.S. PATENT DOCUMENTS

| | | | |
|---|---|---|---|
| 1,617,890 | 2/1927 | Abbey | 72/402 |
| 3,166,359 | 1/1965 | Bleicher | 308/3 R |
| 3,335,594 | 8/1967 | Peterman et al. | 72/402 |
| 3,396,570 | 8/1968 | McCardell | 72/402 |
| 3,451,249 | 6/1969 | Sharon | 72/402 |
| 3,945,237 | 3/1976 | Brignoli | 72/402 |
| 4,103,407 | 8/1978 | Elizalde et al. | 72/402 |

FOREIGN PATENT DOCUMENTS 337514 7/1977 Austria .

*Primary Examiner*—Daniel C. Crane
*Attorney, Agent, or Firm*—Kurt Kelman

[57] ABSTRACT

Known swaging machines comprise swaging rams extending in a swaging box in a radial direction with respect to the path for the workpiece and carry swaging dies at their inner ends. To enable swaging rams of small dimensions and a compact structure to be used while avoiding sealing problems, the swaging rams have an elliptical cross section, with a major axis extending parallel to the workpiece path.

1 Claim, 2 Drawing Figures

Figures 1, 2:
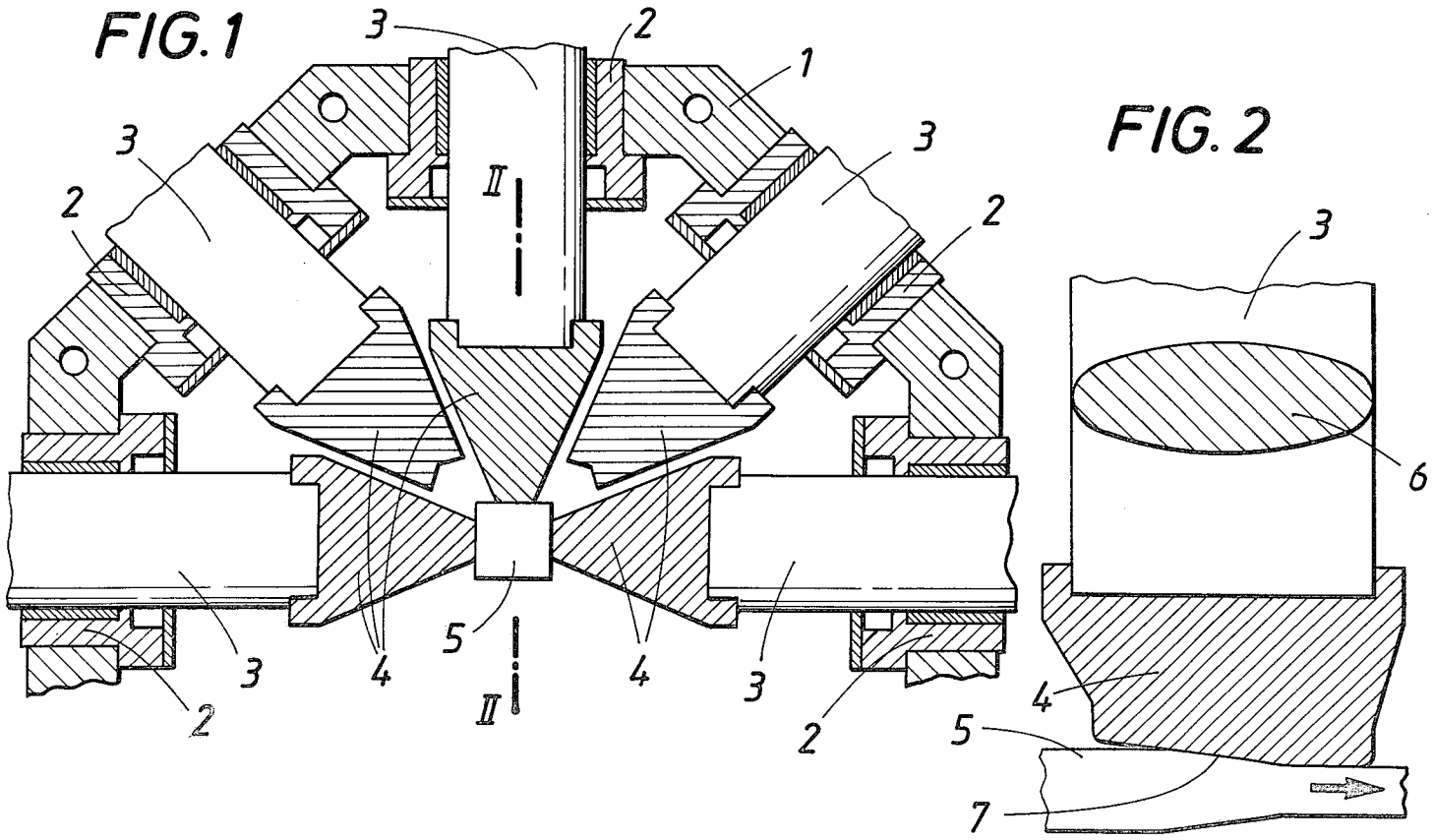

1
2
3
4
5
6
7
II

SWAGING MACHINE

This invention relates to a swaging machine which comprises swaging rams which define a common swaging plane and are mounted in a swaging box and extend radially of the axis of the workpiece or the path of the workpiece in said box and carry swaging dies at their radially inner ends.

Such swaging machines serve mainly for swaging continuous or rod-shaped workpieces of various cross-sectional shapes in such a manner that the dies engage the workpiece throughout its contour in the swaging plane. In order to obtain a particularly good finish and to ensure that a formation of flashes will be avoided, those surface portions of the workpiece which are struck upon by said dies must overlap so that the dies must strike in alternation and the swaging rams together with their bearings and drive means must be properly arranged. Almost all known swaging rams are circular in cross-section and their diameter is selected with a view to the dimensions of the swaging dies. For a proper arrangement, support, guidance, adjustment and drive of said rams, a relatively large swaging box is required, which involves a relatively high structural expenditure and has dimensions which increase considerably as the number of dies is increased because, in view of the diameter of the rams, the space required for the bearings is available only at a certain radial distance from the axis of the workpiece. It will be understood that an increase of the size of the swaging box requires also an increased length of the swaging rams so that the masses to be moved are increased too as well as the driving power, reaction forces and vibration. Accordingly, the total weight increases enormously. For these reasons the manufacture, transportation, installation and operation of swaging machines, especially multiple-die swaging machines, have involved difficulties mainly due to the size and weight of such machines.

Whereas swaging machines are known which have hammers that are rectangular in cross-section, swaging rams having such a cross-sectional shape cannot be satisfactory because, owing to the means for driving, mounting and guiding the rams, they must be lubricated in the swaging box and polygonal rams cannot be properly sealed.

It is an object of the invention to eliminate these disadvantages and to provide a swaging machine which is of the kind described first hereinbefore and which is distinguished mainly by being relatively small in size and structurally compact whereas it does not involve any sealing problems.

This object is accomplished according to the invention with swaging rams of a substantially elliptic cross-section, the major axis of which is parallel to the path for the workpiece. Owing to such elliptic cross-sectional shape, the rams and the means for guiding them can be properly sealed toward the workpiece by means of simple sealing rings because the elliptic or similar elongated shape permits said sealing rings to engage the rams and ram guides under pressure throughout the boundary curve without any discontinuity so that a leakage will be reliably prevented. As the major axis of the cross-section extends along the path for the workpiece, the rams may be relatively slender so that space for accommodating the bearings and other means associated with the rams is available between the latter, and the size of the swaging box can be correspondingly reduced. As a result, the rams may be shorter. Owing to their elongated cross-section, the rams are lighter in weight than the known rams which are circular in cross-section. But because the dies have an elongated striking surface, they can be properly supported by the rams in spite of their narrow, elongated cross-sectional shpae so that the occurrence of undesirable stresses as the workpiece arrives at and leaves the dies need not be feared. Besides, there is no need for special means for holding the rams against rotation and the overall structure is compact and involves only a low expenditure.

An illustrative embodiment of the invention is strictly diagrammatically shown in the drawing, in which:

FIG. 1 is a fragmentary transverse sectional view showing a part of a swaging machine according to the invention and FIG. 2 is a longitudinal and transverse sectional view showing a swaging ram of said swaging machine.

A swaging box 1 has ram guides 2, in which swaging rams 3 are slidably guided. The rams 3 extend radially with respect to the path for the workpiece and at their radially inner ends carry respective swaging dies 4. Eight swaging rams 3 are provided, which define a common swaging plane and carry dies 4 for swaging a rod-shaped workpiece 5 to a square cross-section. The adjacent dies strike in alternation so that they can engage workpiece throughout its contour without a mutual interference of the dies.

To permit in spite of the relatively large number of rams the design of a machine which is relatively small in size and light in weight and has a compact structure involving only a low expenditure, the rams have an elliptic cross-section 6 having a major axis extending in the direction of the path for the workpiece 5. That cross-section 6 has the same length and width as the striking surface 7 of the swaging dies 4 so that the workpiece will be properly supported as it arrives at and departs from the dies and no tilting moments will occur during the swaging operation. Owing to that elliptic cross-section 6 of the swaging rams 3, the radial dimensions of the swaging box can be reduced because correspondingly larger spaces for accommodating bearings and guides are left between said slender rams so that the machine can have the desired compact structure with all advantages afforded by it. Besides, the swaging rams 3 may also be shorter and lighter in weight, the inertial forces which occur are smaller and give rise to smaller problems due to vibration, and the structural expenditure involved in the means for driving and guiding the rams can be reduced, too. That elliptic cross-section may be slender and nevertheless has no point of discontinuity, and the rams 3 can be sealed from the workpiece 5 in the required manner with extremely simple means without any danger of leakage.

What is claimed is:

1. In a swaging machine comprising:

a swaging box defining therein a path for a workpiece to be swaged, a plurality of swaging rams which are disposed in said swaging box, extend radially with respect to said path and define a common swaging plane which intersects said path, and a plurality of swaging dies secured to respective ones of said rams at the radially inner ends thereof, the improvement residing in that each of said rams has a substantially elliptic cross-section which has a major axis that is parallel to said path with the rams being mounted on guides provided with sealing rings such that said sealing rings engage the rams throughout their boundary curve without any discontinuity.

* * * * *